US009334670B2

(12) United States Patent
Cowie et al.

(10) Patent No.: US 9,334,670 B2
(45) Date of Patent: May 10, 2016

(54) RETRACTABLE FENCING OR BARRIER

(76) Inventors: Jeremy Bruce Cowie, Kelowna (CA); Alden Marlowe Roos, Kelowna (CA)

( * ) Notice: Subject to any disclaimer, the term of this patent is extended or adjusted under 35 U.S.C. 154(b) by 350 days.

(21) Appl. No.: 13/882,967

(22) PCT Filed: Nov. 1, 2010

(86) PCT No.: PCT/CA2010/001745

§ 371 (c)(1),
(2), (4) Date: May 1, 2013

(87) PCT Pub. No.: WO2012/058744

PCT Pub. Date: May 10, 2012

(65) Prior Publication Data

US 2013/0221301 A1 Aug. 29, 2013

(51) Int. Cl.

| | |
|---|---|
| ***E04H 17/20*** | (2006.01) |
| ***G08B 21/08*** | (2006.01) |
| ***E04H 17/00*** | (2006.01) |
| ***E04H 4/06*** | (2006.01) |
| ***E04H 17/18*** | (2006.01) |

(52) U.S. Cl.
CPC ..... *E04H 17/00* (2013.01); *E04H 4/06* (2013.01); *E04H 17/18* (2013.01)

(58) Field of Classification Search
CPC ..... E04H 4/06; E04H 17/16; E04H 17/20; G08B 21/086; E01F 13/028; E01F 13/044; E01F 13/046; E01F 13/048
See application file for complete search history.

(56) References Cited

U.S. PATENT DOCUMENTS

| | | | | |
|---|---|---|---|---|
| 2,805,046 | A * | 9/1957 | Petterson | 256/25 |
| 3,391,515 | A * | 7/1968 | Clay | 52/709 |
| 6,997,638 | B2 * | 2/2006 | Hensley et al. | 404/6 |
| 7,568,857 | B2 * | 8/2009 | Riotto | 404/6 |

FOREIGN PATENT DOCUMENTS

| | | | | |
|---|---|---|---|---|
| EP | 1 106 751 | * | 6/2001 | E04H 17/00 |
| FR | 2 908 438 | * | 5/2008 | E04H 4/06 |

* cited by examiner

*Primary Examiner* — Michael P Ferguson
(74) *Attorney, Agent, or Firm* — Anthony C. Edwards

(57) ABSTRACT

A retractable fence system for a pool surround includes an array of ground tubes mounted around the pool. A resiliently upwardly biased substantially hollow post is slidably mounted in each ground tube. A retractable non-resilient flexible fence panel is mounted within each post so that, when the post is fully extended above ground, the fence panel maybe selectively extended laterally from the post, through a vertical slot in the sidewall of the post. The distal end of the fence panel, when extended, releasably mounts to a next adjacent post.

9 Claims, 25 Drawing Sheets

RETRACTABLE FENCING OR BARRIER

FIELD OF THE INVENTION

This invention relates to the field of removable barriers for example for surrounding a pool, and in particular to a retractable fence system wherein retractable flexible fence panels are stored in and extend from, posts which themselves telescopically retract down into and extend upwardly from tubes mounted in the ground.

BACKGROUND OF THE INVENTION

In many jurisdictions building codes require that at least a four-foot high non-climbable fence be provided around a pool. In many instances, residence owners will choose, instead of having a non-climbable fence directly adjacent the pool, to build a four-foot high non-climbable solid fence around the perimeter of the residential property, thereby complying with the applicable code. The problem with this approach is that, when children and especially young children are allowed out into what is typically the backyard of the residence to play, because the code-required non-climbable fence is around the perimeter of the property, there is no safety barrier provided between where the children are playing and the pool. Consequently, there exists a danger that children will fall into the pool, while playing notwithstanding that the pool is code compliant.

Consequently there exists a need to provide a barrier which may be quickly erected around the immediate circumference of a pool to inhibit children, pets or the like from gaining access to the pool, where the barriers may be easily and quickly retracted out of sight so that when the pool is in use the barriers do not provide an inconvenience to the users nor do they obstruct or mar the look of the landscaping within the perimeter of the property.

It is known in the prior art, for example that exemplified by U.S. Pat. No. 5,161,784 which issued to Sader on Nov. 10, 1992 for a Knock-Down Barrier for Preventing Admittance into an Area, to provide a knock-down barrier which prevents admittance into an area or pool where each of a plurality of barrier members may include a hollow tubular upright having support posts which are supported in holes located within the ground.

It is also known, as exemplified in U.S. Pat. No. 5,152,508 which issued to Fish on Oct. 6, 1992, for a Removable Safety Barrier Which May be Erected Around the Perimeter of a Swimming Pool, to provide a barrier includes upright elements which are positionable end-to-end around the pool. An electrical connection is made between adjacent barrier elements to provide an alarm, where the electrical connection is supported on restraining mesh extending between support members.

In the prior art, applicant is also aware of U.S. Pat. No. 5,553,833 which issued to Bohen on Sep. 10, 1996 for a Safety Barrier Mount, wherein Bohen describes that he has improved prior art barriers made of a number of flexible panels which are attached to poles. Each pole is inserted into a sleeve receptacle. Each pole has a key at its lower end and each sleeve has a keyway to receive the corresponding pole's key.

United States Patent Application, Publication No. 2003/0164485, filed by Olson et al and published on Sep. 4, 2003, for a Retractable Fence Assembly describes an upright container that houses a coil of fencing material, for example in the form of a web of synthetic material, where the web is wound up on a core within the container so as to be rotatable upon a normally stationary spindle. A helical return spring interconnects the core and the spindles so that fencing is pulled out of the container through a dispensing slot in the side wall of the container against a return biasing force of the spring. The container is not retractable into the ground, but rather, Olson et al teach to mount a single such container to a work truck and to form the entire barrier from the web pulled from the single container.

In the prior art which relates to barriers that are retractable to into and out of the ground, applicant is aware of U.S. Pat. No. 5,630,572 which issued to Guay on May 20, 1997, for a Retractable Fence System for Swimming Pool or the Like, wherein Guay discloses a fence system which includes a trench and a collapsible screen which is mounted in the trench. A lifting device which engages the top of the screen raises and lowers the screen between an extended position out of the trench and a retracted position inside the trench. A closure closes the trench when the screen is in its retracted position.

Applicant is also aware of U.S. Pat. No. 5,168,584 which issued to Peebles on Dec. 8, 1992 for a Retractable Perimeter Barrier, wherein Peebles discloses a retractable perimeter barrier for a swimming pool where the barrier includes a plurality of panels each vertically movably positioned in a edge-to-edge orientation within a trough. Each panel includes a lower buoyant section which supports an upper portion of the panel which extends above ground when the trough is filled with water. The panels retract into the trough when the water is drained from the trough.

SUMMARY OF THE INVENTION

The retractable fencing according to the present invention is not intended to be a replacement for code-required four-foot high non-climbable solid fencing but rather to provide a barrier around the perimeter of a pool, where the barrier may be for example erected at night or during social events where there will be small children who may be unattended, or during occasions when small children will be near the pool and unattended by adults, so as to inhibit the children falling into the pool.

In one embodiment the retractable fencing includes posts which contain flexible web or mesh or flexible sheets or panels or the like (collectively herein referred to as flexible fence panels) which pull-out from the interior of the post through a vertical slot in the post once the post has been elevated telescopically from corresponding silos or tubes (collectively herein referred to as ground tubes) mounted vertically downwardly into the pool deck or other pool surround. The posts may be selectively extended telescopically from their corresponding ground tubes, and once fully extended vertically upwardly, the flexible panels may be pulled laterally from their storage position within each post wherein they are mounted on a spring-loaded vertical roller. The leading edge of the free end of each panel attaches to the adjacent post. Annular collars are provided between the posts and the corresponding walls of the ground tube to inhibit entry of dirt, debris or the like into the ground tube.

In summary, the retractable fence system for pool surround in aspect may be characterized as including an array of ground tubes mounted in the ground or deck etcetera surrounding the pool in spaced apart array, where the spacing is dictated by the available length of retractable flexible fence panels carried in vertically retractable posted mounted in the ground tubes.

Thus the array or plurality of hollow ground tubes are adapted for mounting substantially vertically into ground, and each ground tube contains a resiliently upwardly biased substantially hollow post upwardly biased by a resilient actuator journalled in the ground tube. The post is adapted for sliding, vertically telescopic, translation relative to the ground tube between the post's fully upwardly extended position and the post's fully lowered retracted position. In the fully lowered retracted position the top of the post is flush with the top of the ground tube, which itself is flush with ground level.

The retractable non-resilient flexible fence panel is selectively retractably mounted within the post so that when the post is in its fully extended position, the fence panel may be selectively extended laterally from the post between a laterally retracted position substantially fully contained within the post, and a laterally extended position extended laterally relative to the longitudinal axis of the post. The fence panel extends and retracts through a vertical slot in the sidewall of the post.

The fence panel has a base end opposite to a leading end. The base end is mounted to a retraction mechanism, for example a roller mechanism mounted within the post. The leading end is located in the slot when the fence panel is in its laterally retracted position. A substantially rigid latching member may be mounted to and along the leading end of the fence panel. The latching member is adapted to releasably mount to a next adjacent post corresponding to a next adjacent ground tube spaced apart in the plurality of hollow ground tubes.

A collar is rigidly mounted at an upper end of the ground tube the post slides through the collar. The collar substantially covers the upper end of the ground tube when the post is positioned in the collar.

A post latching system is provided to selectively latch the post in both of its fully extended position and its fully retracted position in the tube. A fence panel latching system is provided to latch the fence panel in at least its fully laterally extended position so as to inhibit deforming by lifting or lowering of the fence panel when extended by inhibiting further lateral extension of the fence panel from the post beyond the amount of lateral extension of the fence panel required to attain the fully laterally extended position. The amount of lateral extension of the fence panel in its fully laterally extended position is dictated by the spacing distance between the post and its next adjacent post.

Advantageously the post includes a traveler block mounted at a lower end of the post. The traveler block maybe elongate in the longitudinal direction of the ground tube and sized to substantially snugly slidingly fit within the ground tube. The traveler block travels vertically between the collar and the actuator. The traveler block and the inner wall of the ground tube may include at least one mating vertical rail and corresponding channel pair for interlocked vertical sliding translation of the block along the tube. For example, the channel may be formed in the traveler block and the rail may be mounted or formed on the inner wall of the tube. More than one rail/channel pairs may be provided spaced apart around the block and tube.

In one embodiment the post includes an internal roller mechanism and the flexible fence panel is stored, when in the fully laterally retracted position, rolled within the post on the internal roller mechanism. In that embodiment, the fence panel latching system may include the internal roller mechanism. The fence panel has a height dimension and wherein the height dimension may be substantially equal to a longitudinal length of the post above the traveler block.

The rigid latching member may include at least one latch coupling member mounted thereon adapted to releasably couple to the next adjacent post when the fence panel is in the fully laterally extended position. The next adjacent post is adapted to releasably couple to the coupling member. The collar may include at least one notch to accommodate vertical translation of the coupling member when carried in the vertical translation of the post relative to the collar. Second latch coupling members may be mounted on the post for coupling with the latch coupling member on the fence panel from an adjacent post. Further notches may be formed in the collar to accommodate vertical translation of the second latch coupling members.

DETAILED DESCRIPTION OF EMBODIMENTS OF THE INVENTION

Figure 1A:
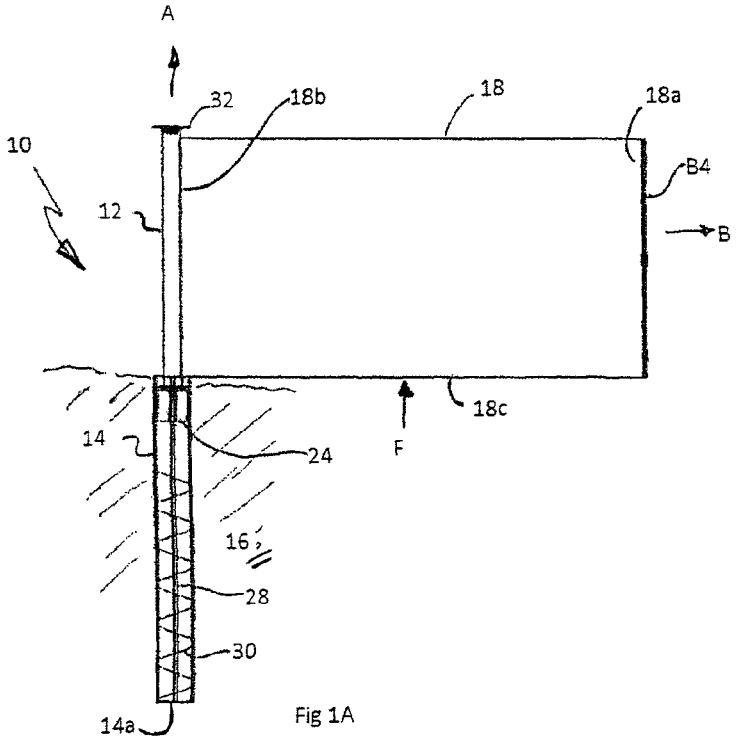
FIG. 1*a* is, in front elevation partially cut-away view, a retractable fence system according to one embodiment of the present invention mounted into the ground with its post fully telescoped from its ground tube and the flexible fence panel extended from within the post.
Figure 2:
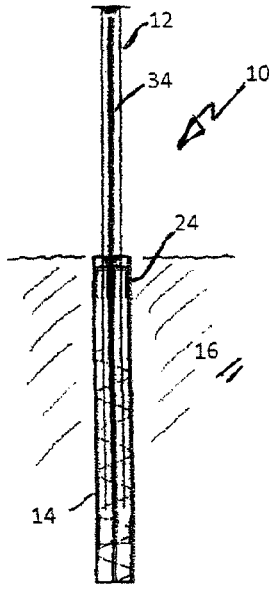
FIG. 2 is, in side elevation view, the retractable post unit of FIG. 1.
Figure 1B:
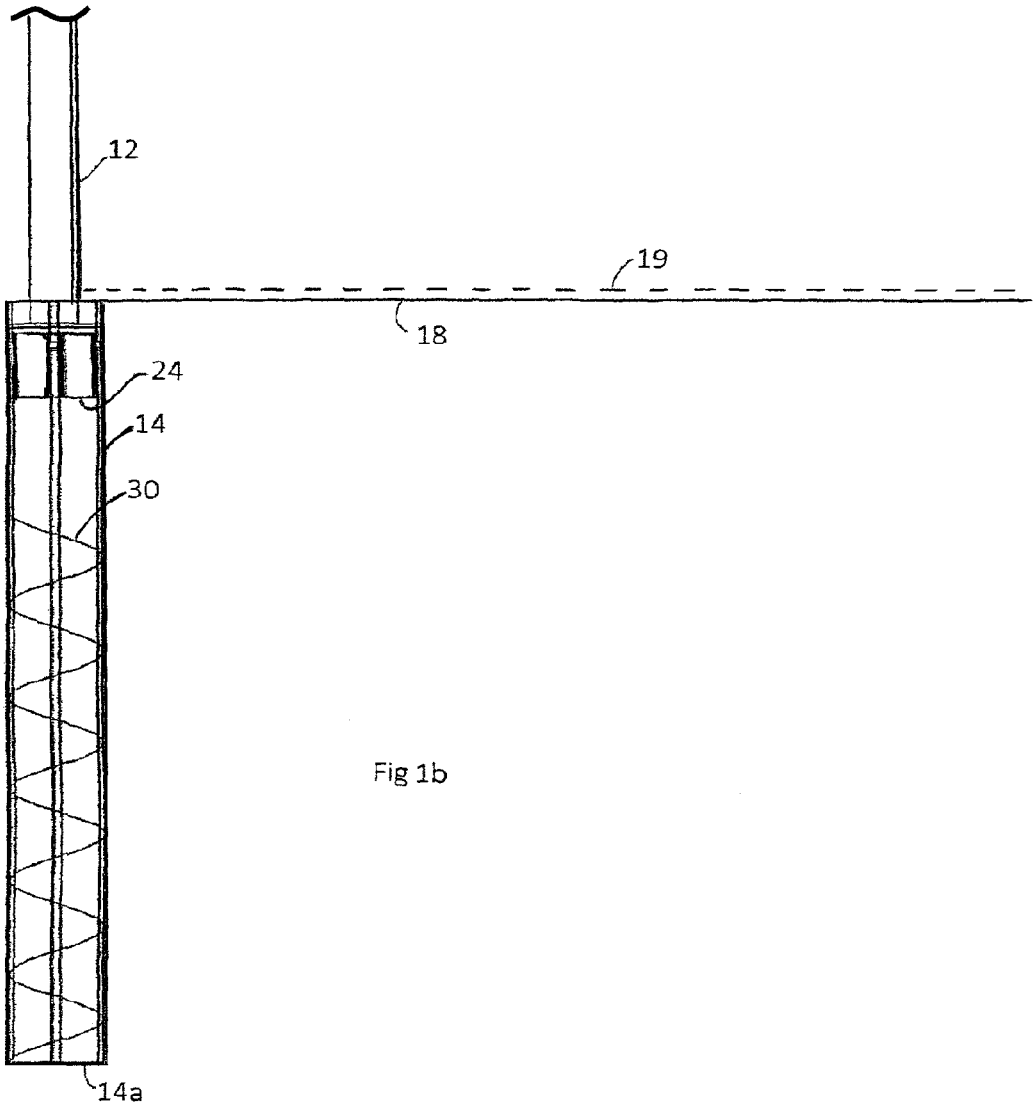
FIG. 1*b* is an enlarged view of the lower portion of FIG. 1*a*.
Figure 3:
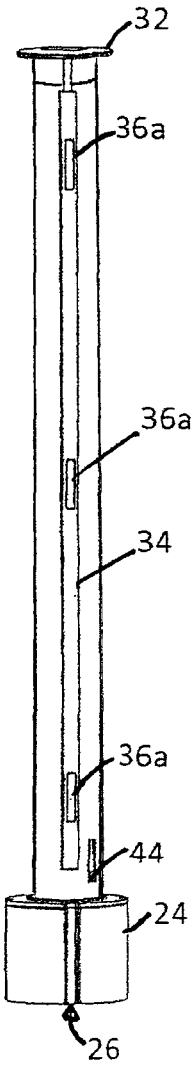
FIG. 3 is in partially cutaway top perspective view, the post and traveler block of the retractable fence system of FIG. 1*a*.
Figure 3A:
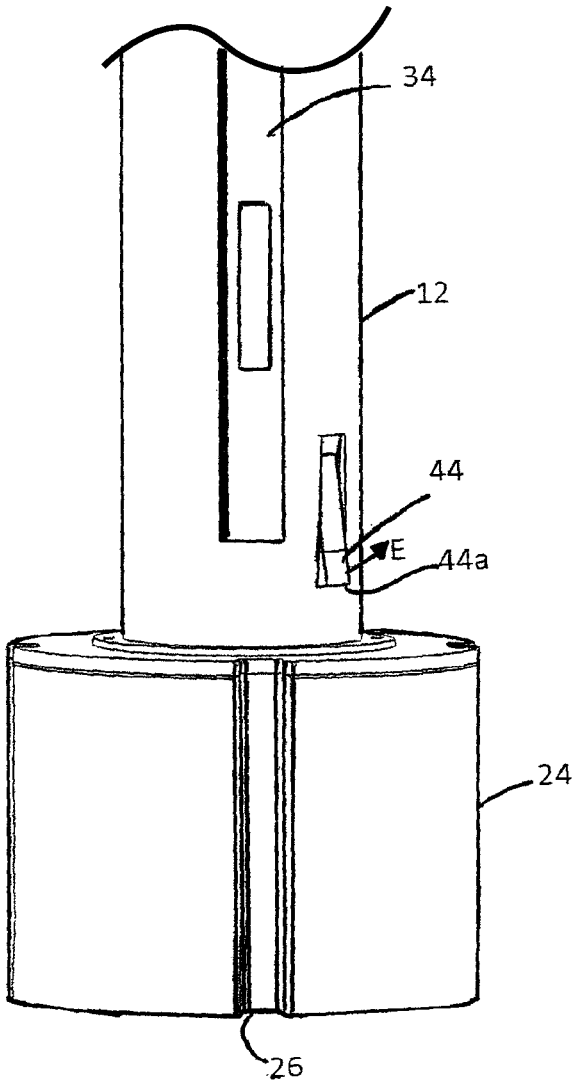
FIG. 3*a* is an enlarged view of the lower portion of FIG. 3.
Figure 3B:
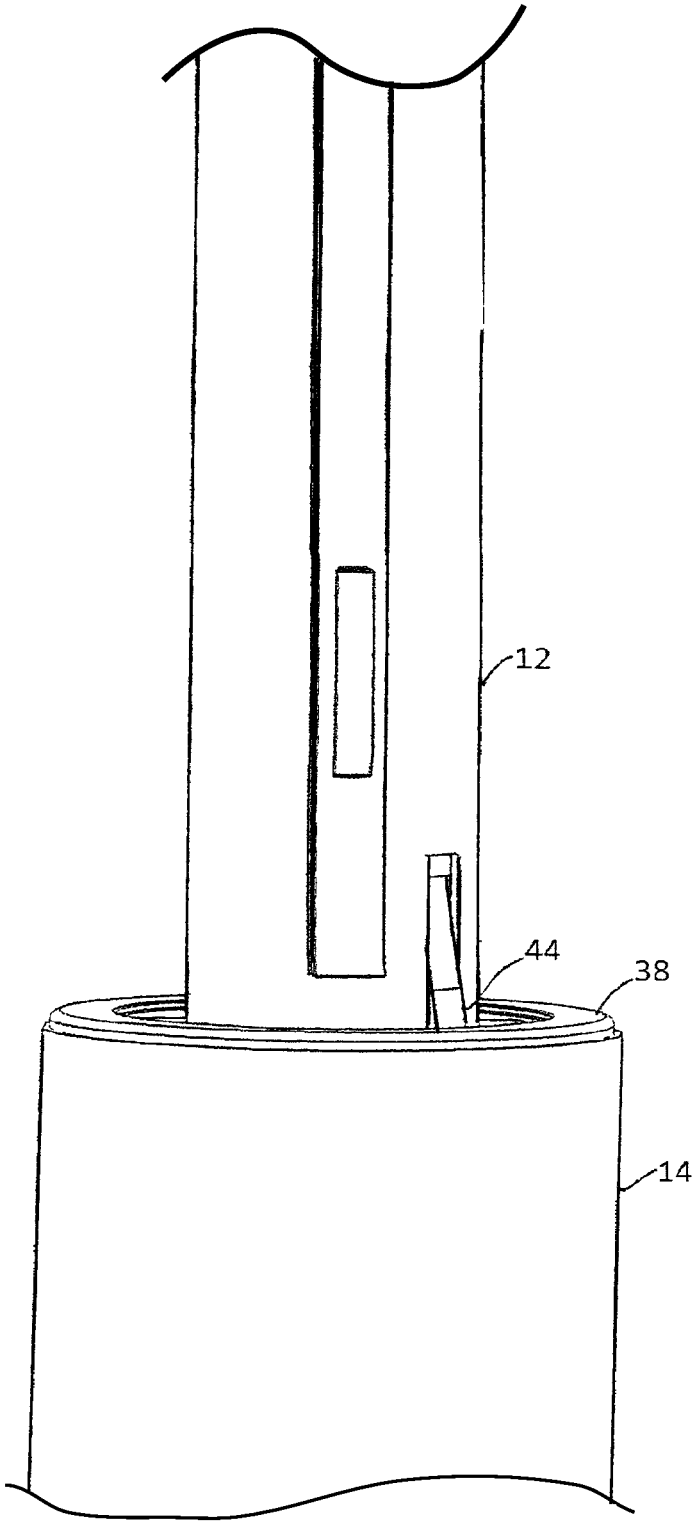
FIG. 3*b* is the view of FIG. 3*a* with the traveler block mounted in the upper end of the ground tube.
Figure 3C:
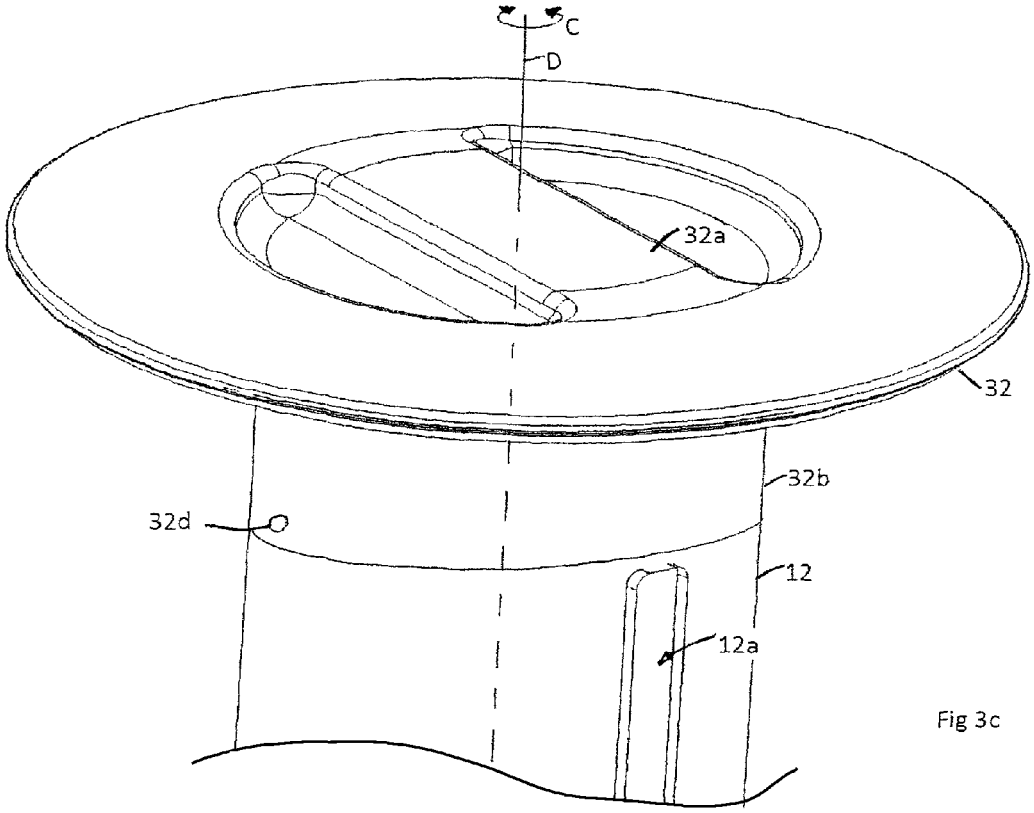
FIG. 3*c* is an enlarged view of the upper portion of FIG. 3.
Figure 4:
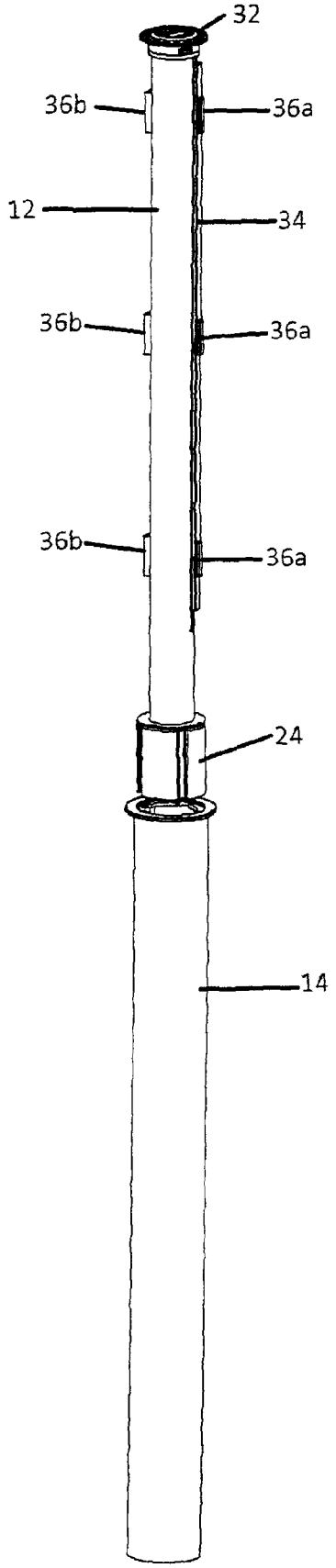
FIG. 4 is, in top perspective view, the retractable fence system of FIG. 1 with the traveler block exploded up out of the top end of the ground tube and the flexible fence panel retracted
Figure 4A:
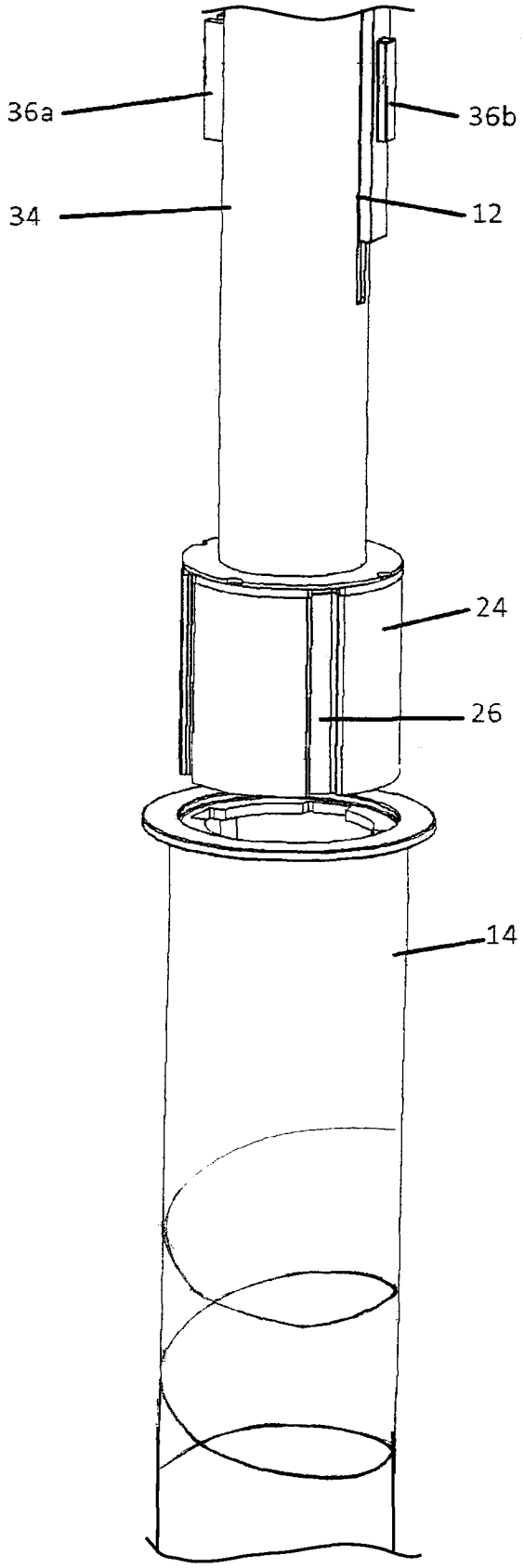
FIG. 4*a* is an enlarged view of a center portion of FIG. 4.
Figure 4B:
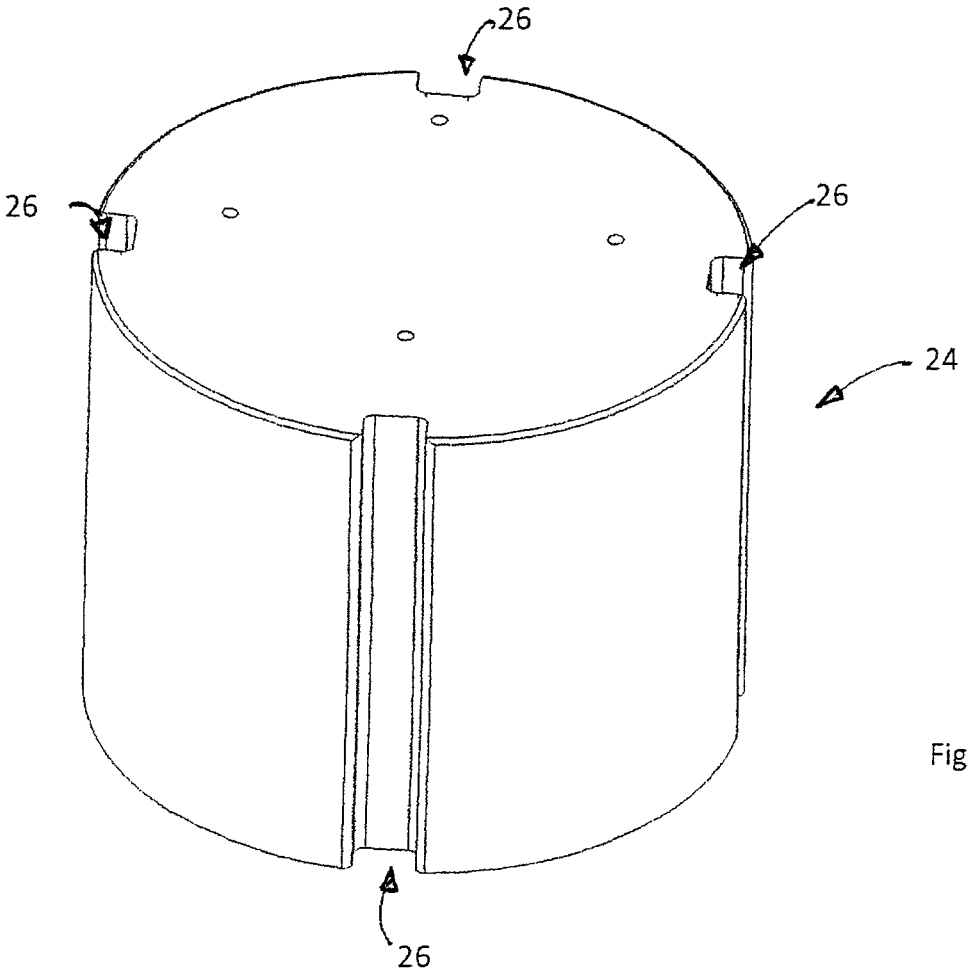
FIG. 4*b* is, in top perspective view, the traveler block of FIG. 4.
Figure 4C:
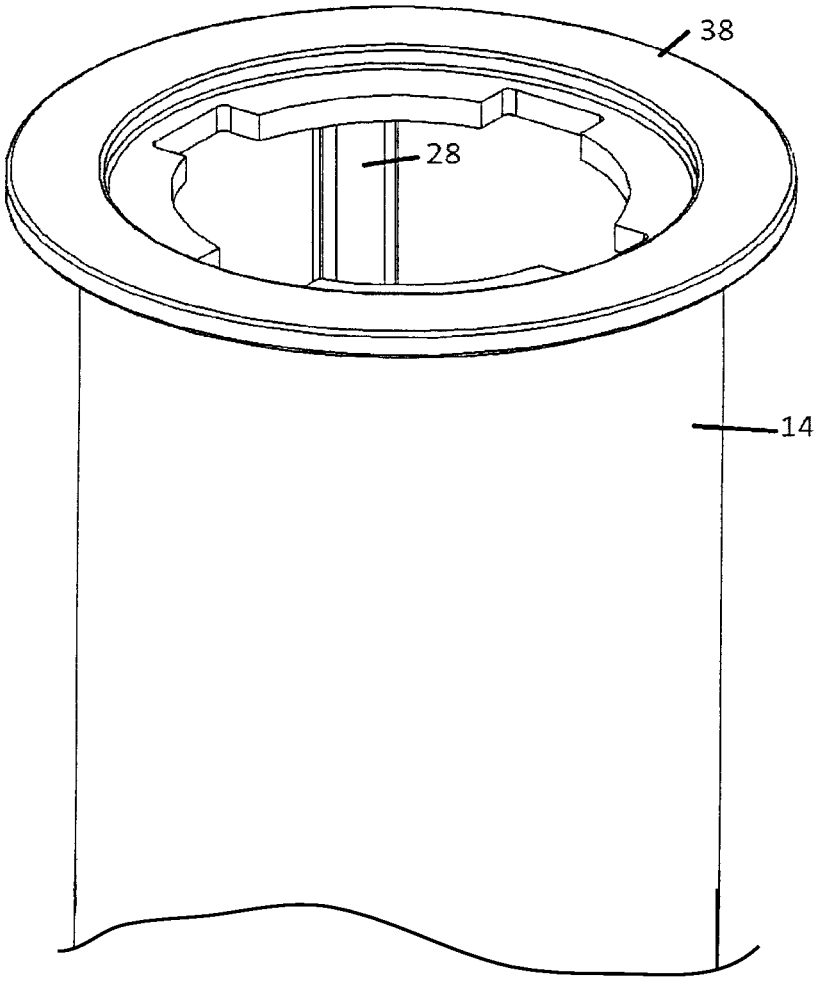
FIG. 4*c* is, in top perspective view, the top of collar on upper end of the ground tube of FIG. 4.
Figure 4D:
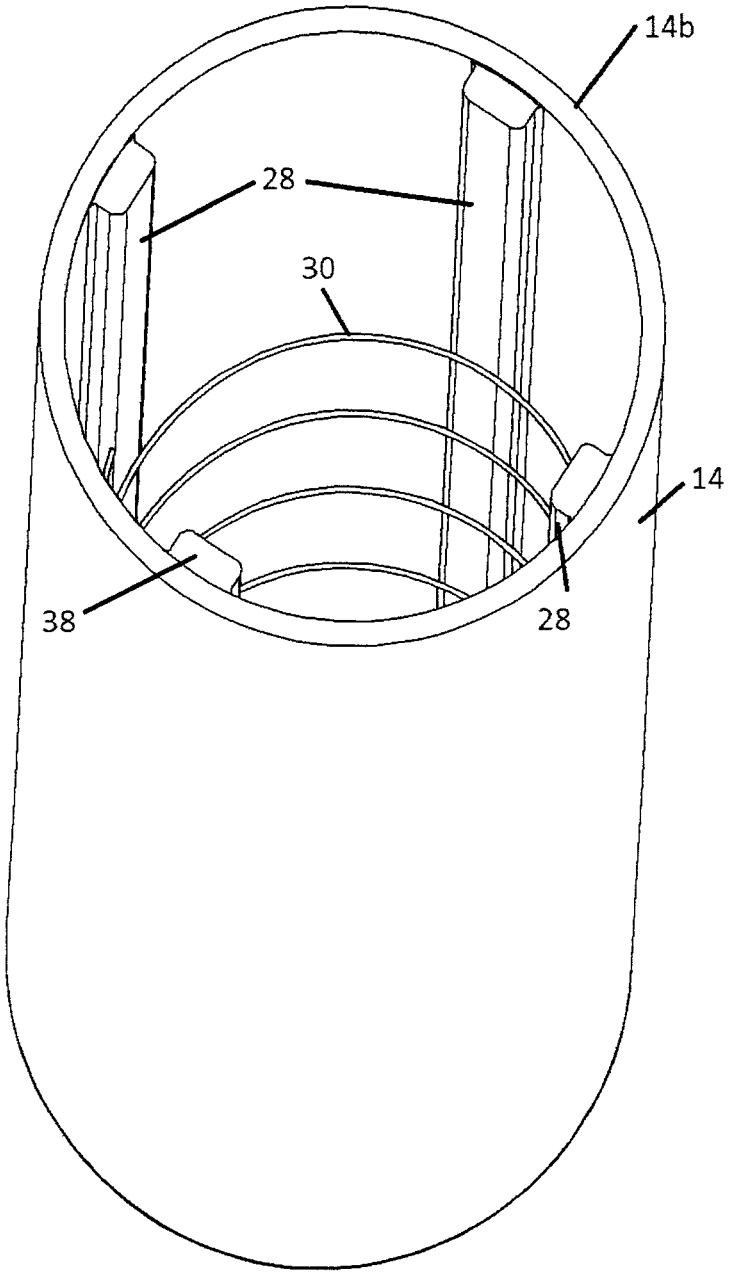
FIG. 4*d* is the ground tube of FIG. 4*c* with the collar removed.
Figure 4E:
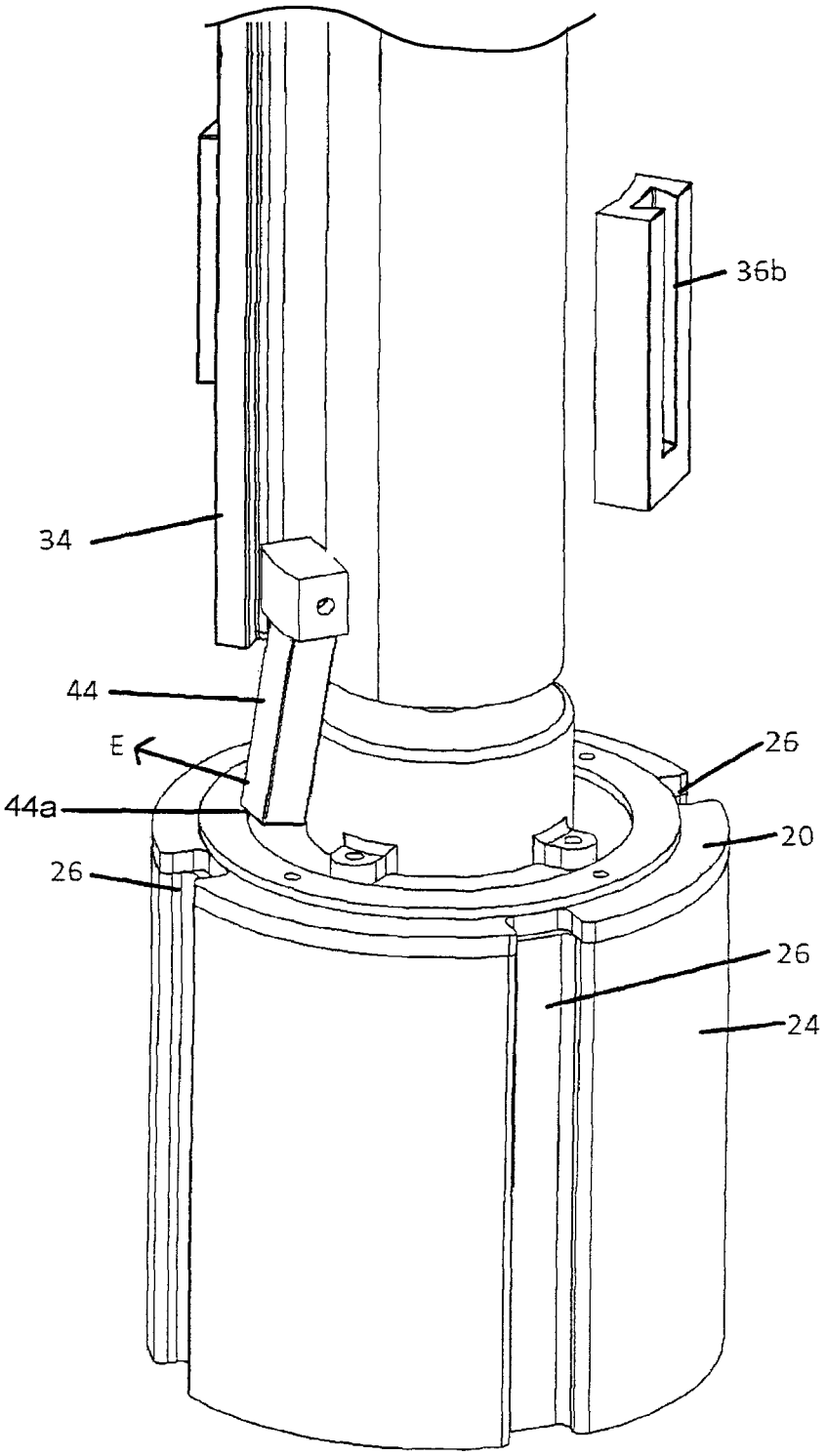
FIG. 4*e* is the lower end of the post and traveler block of FIG. 4.

The retractable fence system 10 according to one embodiment of the present invention includes a post 12 telescopically mounted in a hollow ground tube 14 which is mounted in the ground 16. A non-resilient flexible fence panel 18, which may be a webbing or fabric sheet or the like, is roller-mounted within post 12 so that, when post 12 has been elevated in direction A from its retracted position fully enclosed within tube 14, fence panel 18 may be extended in direction B from its retracted position fully contained within post 12.

A plurality of retractable fence systems 10 are mounted in substantially equally spaced apart array around the perimeter of a pool so that the leading edge 18*a* of a fence panel 18 when extended in direction B may be brought into engagement against an adjacent post 12 and leading edge 18*a* releasably mounted to the adjacent post so as to provide one section of a barrier of adjacent extended panels 18. Thus each post 12 has a corresponding fence panel 18. A spindle roller 40 is mounted within each post 12 so that, with each post 12 in its fully raised position, each of the corresponding flexible fence panels 18 may be unrolled from their roller mounting within post 12 and the leading edges 18*a* releasably mounted, for example by the latching mechanism described below, to the adjacent post so as to fully enclose the perimeter of the pool or other area being cordoned off.

Ground 16 may be comprised of soil, gravel and the like, and is understood to encompass all forms of ground cover or pool surrounds, including where the ground tubes 14 are mounted into concrete pool decking or through a top cover of grass or the like.

Each post 12 is mounted at its lower most end onto a base plate 20 by means of annular flange 22. Base plate 20 in the illustrated embodiment which is not intended to limiting, is substantially circular and mounted down onto correspondingly sized cylindrical traveler block 24. Traveler block 24 has at least one linear guide channel 26 formed as a vertical channel extending the height of traveler block 24. Four channels 26 are shown by way of example in the illustrated embodiment. Base plate 20 has at least one corresponding notch 20*a* which is aligned with its corresponding channel 26 so that, when traveler block 24 is slidably mounted for vertical translation in ground tube 14, and when ground tube 14 is mounted vertically in ground 16, vertical guide rails 28 slidingly mate in channels 26 and their corresponding notches 20*a* so that traveler block 24 may translate vertically in direction A as part of the base of post 12. Rails 28 provide additional strength to the sidewalls of ground tubes 14, prevent traveler blocks 24 from rotating within their tubes and assist in inhibiting jamming of the traveler blocks as they are raised and lowered in the ground tubes. Rails 28 also provide mounting points, at the top of each rail, for attaching collar 38. In addition the guide rails 28, in that they are snugly mated within channels 26, assist in providing lateral stability to posts 12 when they are fully vertically extended so as to be fully cantilevered from the top of tubes 14.

Ground tube 14 may advantageously have an apertured base 14*a* that provides for drainage from tube 14. A resilient actuator such as a helical coil spring 30 is mounted in tube 14, between traveler block 24 and apertured base 14*a*. Spring 30 is compressed as post 12 and traveler block 24 are lowered into the post's fully retracted position wherein post cap 32 is substantially flush with the upper rim 14*b* of tube 14.

Upon release of the latching mechanism described below, the biasing force of the resilient spring 30 initially urges traveler block 24 and post 12 upwardly in direction A. The extent of the vertical travel of post 12 is dictated by the size and relative strength of spring 30 relative to the weight of post 12 and traveler block 24, which may for example weigh in the order of fifty pounds including the weight of the flexible fence panel. In one embodiment, post 12 is urged approximately half way upwardly from tube 14 by the upward urging of spring 30. In use, once post 12 has popped up from tube 14, a user merely has to grasp post 12, for example under the laterally outwardly extending rim of post cap 32, and elevate the post to its full extension so as to allow the upper latching mechanism to engage as described below. In one embodiment traveler block 24 is a relatively heavy weight to assist in stabilizing post 12 when fully extended from tube 14.

To extend flexible fence panel 18, latching bar 34 is grasped and pulled away from post 12. Panel 18 is thereby translated laterally in direction B, that is, orthogonally relative to the longitudinal axis D of post 12. Panel 18 passes through a vertical slot 12*a* formed in the side wall of post 12, it being understood that although post 12 and tube 14 are shown as being cylindrical they may have cross-sectional shapes which are other than circular. A conventional spring biased roller mechanism cooperates with spindle roller 40. For example a ratcheting roller retraction mechanism, or other spring roller mechanism known in the art is mounted within roller spring housing 40*a* to control the rolling and unrolling of panel 18 onto spindle roller 40. Housing 40*a* may for example be mounted onto base plate 20 in the base of hollow post 12.

Fence panel 18 is mounted at its base end 18*b* onto spindle roller 40 within post 12. Fence panel 18 is wound onto roller 40 within post 12 until the latching bar 34 mounted to leading edge 18*a* is retracted flush against slot 12*a*. It is understood that the cylindrical cavity between roller 40 and the sidewall of post 14 is sized to receive the entire length of panel 18 when rolled onto roller 40. Once fence panel 18 is fully retracted, post 12 may be lowered so as to carry latching bar 34 down with it into tube 14. Latching bar 34 has male dove-tail members 36*a* mounted thereon. Dove-tail members 36*a* mate in a sliding dove-tail mounting into corresponding female dove-tail grooved members 36*b* mounted on the side of post 12, for example opposite to slot 12*a*. The angular orientation between members 36*b* and slot 12*a* may be adjusted when members 36*b* are initially mounted onto post 12 in the event that a particular post 12 is mounted for example at a corner of the pool enclosure.

Flush mounting collar 38 mounts down onto rim 14*b* of tube 14. An annular lip 38*a* extends around collar 38. A slightly recessed channel 38*b* is nested concentrically within lip 38*a*. Channel 38*b* has a first notch 38*c* cut out to accommodate the vertical sliding translation therethrough of latching bar 34 and its corresponding male dove-tail members 36*a*, and a second set of notches 38*d* cut out for female dovetail members 36*b*, as post 12 is translated vertically in direction A. A plurality of notches 38*d* may be provided, for example the three illustrated oriented 90 degrees apart from one another, to accommodate the various possible positions about the post of the female dovetail members 36*b*. Channel 38*b* provides a collar around the circumference of the cylindrical side walls of post 12, excepting the notches 38*c* and 38*d*, which substantially covers the opening down into tube 14 so as to inhibit the intrusion of dirt or debris into tube 14. In one embodiment not intended to be limiting an upwardly extending annular lip

38*d* may be mounted around the inner circumference of channel 38*b* to provide a seal against the cylindrical side wall of post 12.

When post 12 is in its fully lowered and retracted position, cap 32 fits concentrically within channel 38*b* so that the upper surface of cap 32 is flush with the upper surface of lip 38*a*. Cap 32 may in one embodiment be provided with a finger grip such as gripping bar 32*a* formed into the upper surface of cap 32 whereby, when post 12 is fully lowered and cap 32 thereby seated in channel 38*b*, a user may grasp gripping bar 32*a* and rotate cap 32 in direction C to thereby rotate latching hooks (not shown) mounted under cap 32 into engagement with corresponding hook receivers (not shown) in or under collar 38. In this embodiment then, cap 32 is free to rotate, at least partially, relative to post 12 (as post 12 is prevented from rotating by guide rails 28). In an alternate embodiment, again not intended to be limiting, rotation of cap 32 relative to cap base 32*b* mounted onto the top of post 14 actuates radially outwardly extending pins 32*c* through apertures 32*d* so as to selectively engage corresponding apertures, notches, grooves or the like (not shown) in the upper end of tube 14 to thereby latch post 12 in its fully retracted position in tube 14. Alternatively still, pins 32*c* may be spring loaded to engage the apertures in tube 14, or piston-type releasing latches as would be known to one skilled in the art may be provided. Other latching mechanisms may be employed as would be known to one skilled in the art.

Figure 5A:
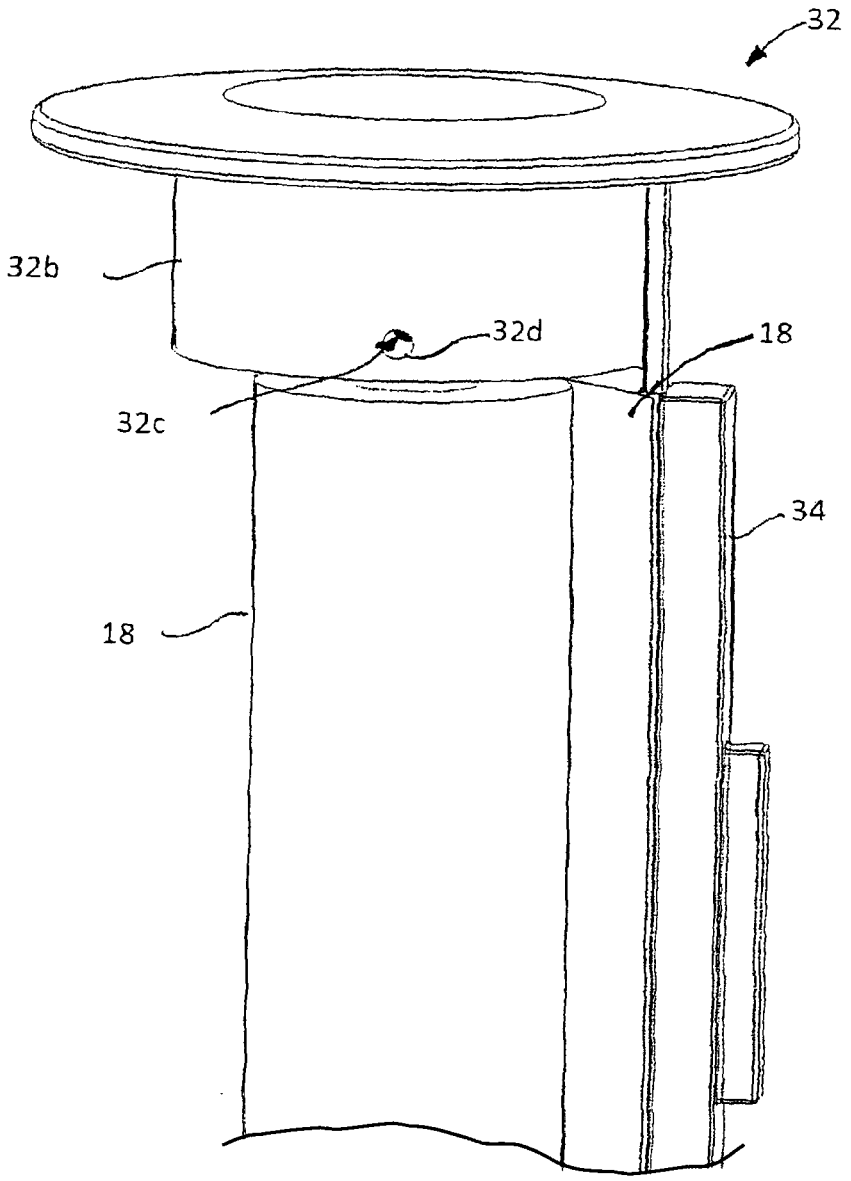
FIG. 5*a* is the upper end of the post of FIG. 3 with the outer post housing removed to show the flexible fence panel rolled onto the roller mechanism.
Figure 5B:
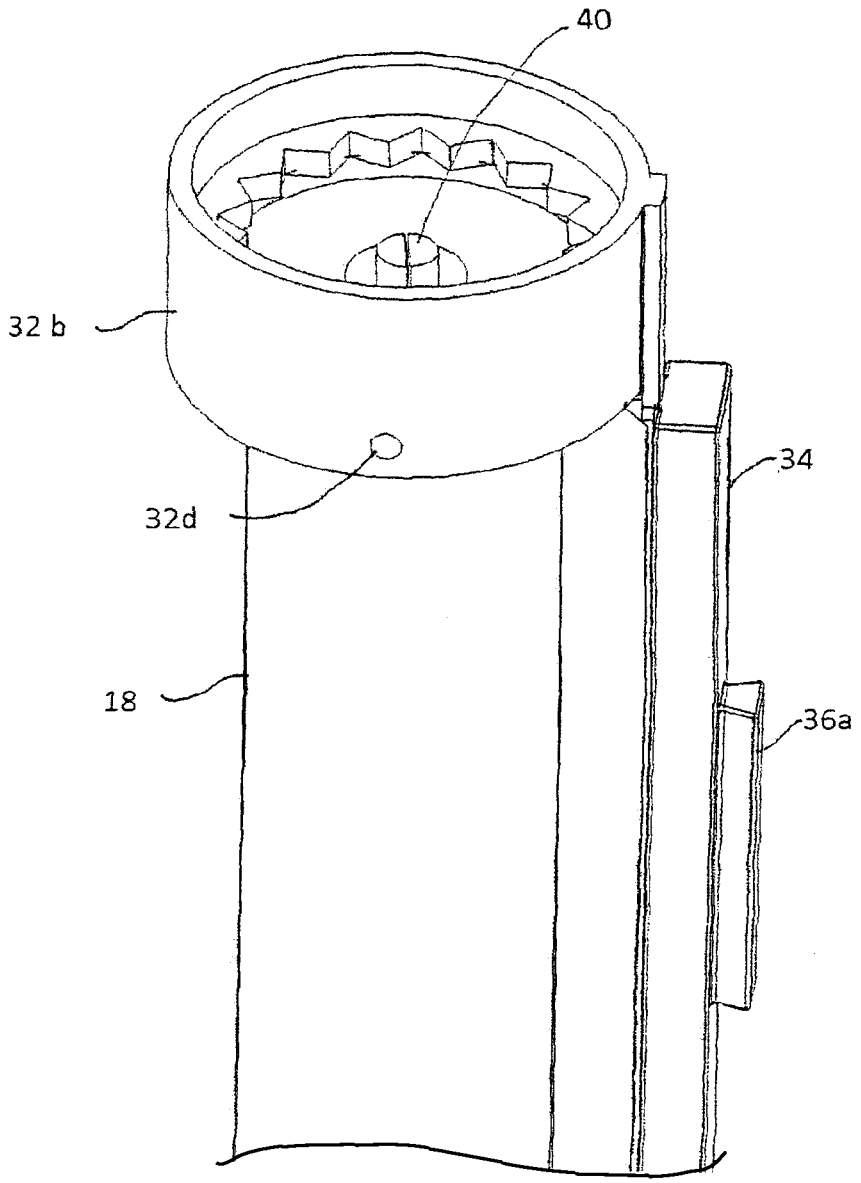
FIG. 5*b* is the view of FIG. 5*a* with the top of the post cap removed and showing ratchet teeth of one embodiment of a ratcheting roller mechanism.
Figure 5C:
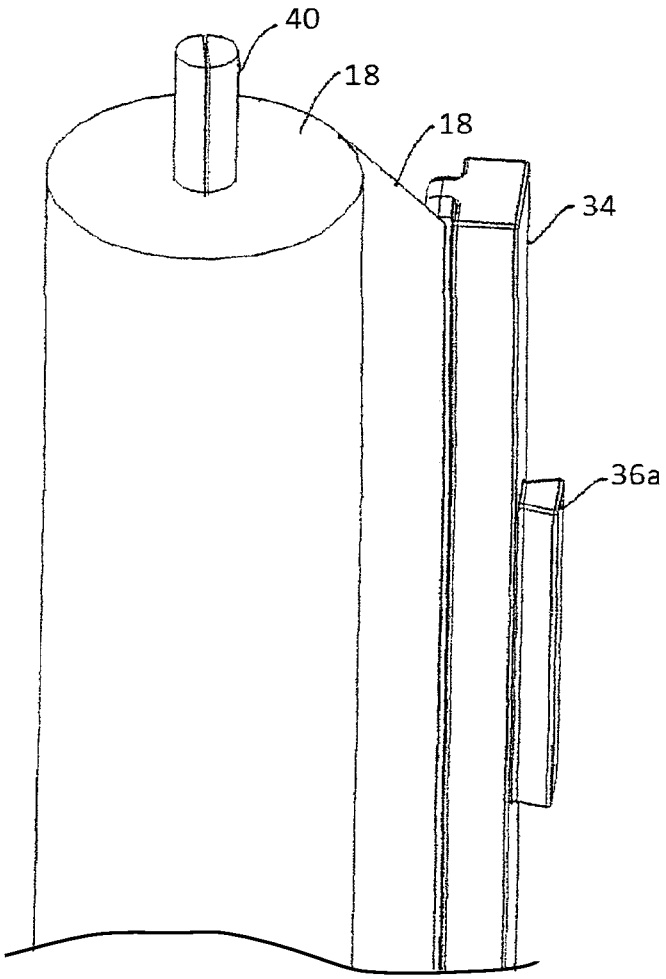
FIG. 5*c* is the view of FIG. 5*b* with the base of the post cap removed.
Figure 5D:
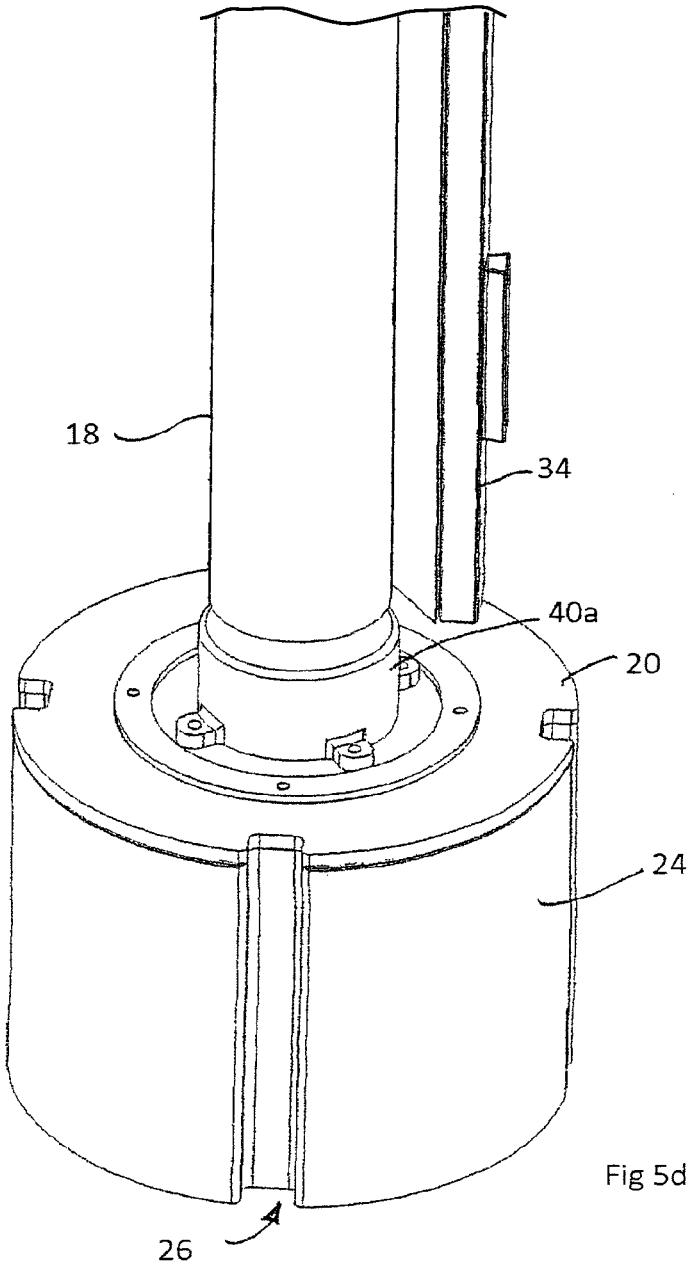
FIG. 5*d* is the lower end of the post of FIG. 5*a*.
Figure 5E:
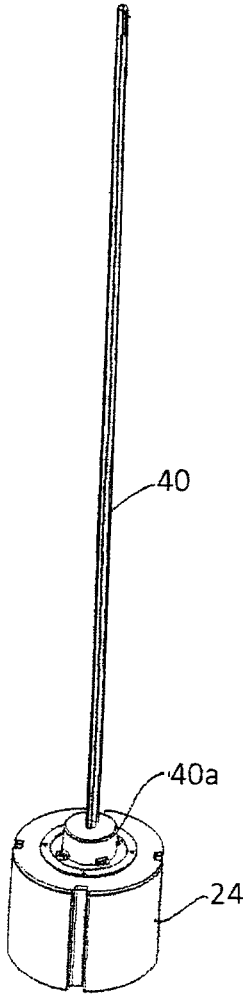
FIG. 5*e* is the lower end of the post of FIG. 5*d* with the flexible fence panel removed.
Figure 5F:
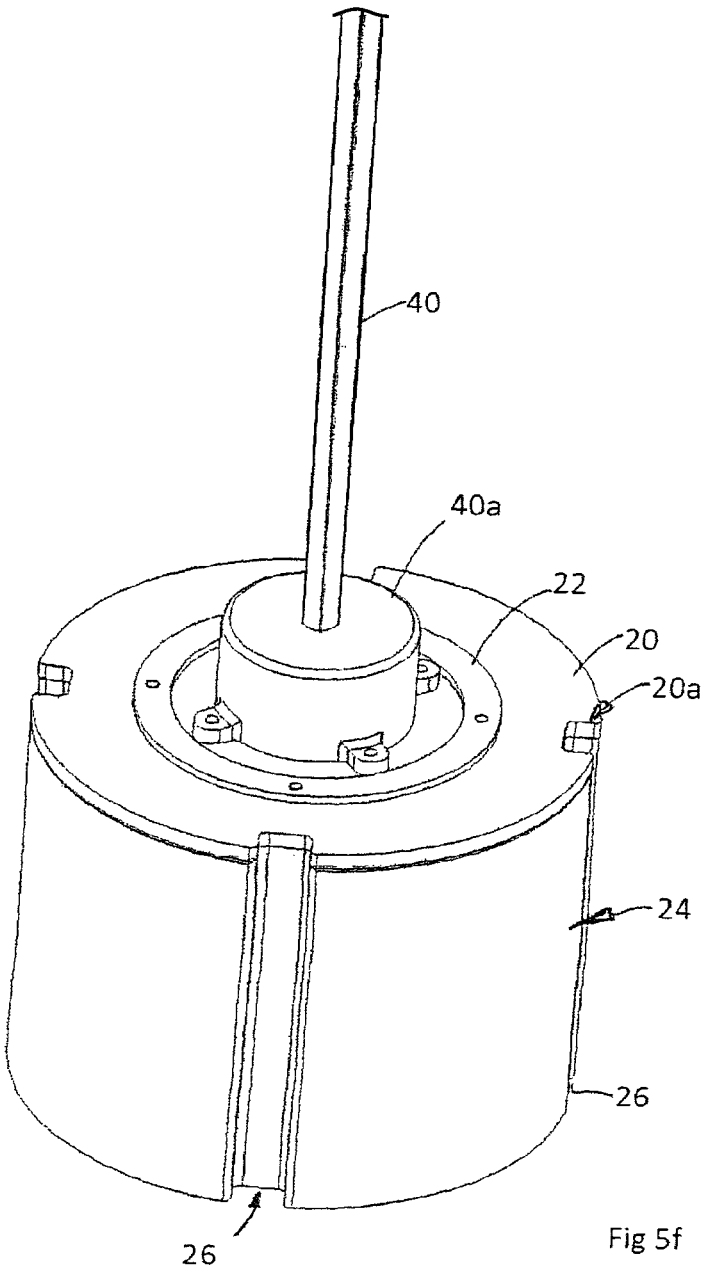
FIG. 5*f* is an enlarged view of the lower end of the post of FIG. 5*e*.
Figure 6A:
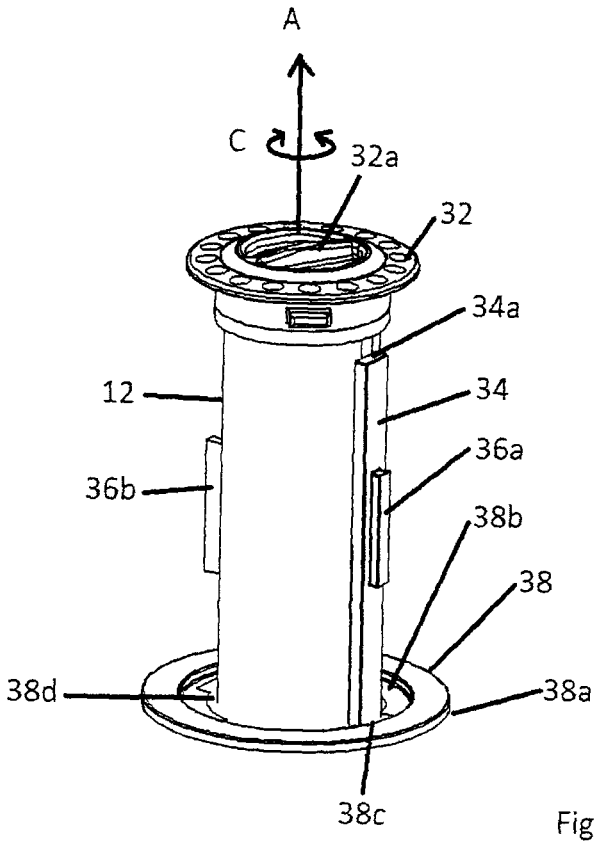
FIG. 6*a* is, in top perspective view, one embodiment of the retractable fence system according to the present invention showing the post partially extended a small vertical distance out of its silo ground tube.
Figure 6B:
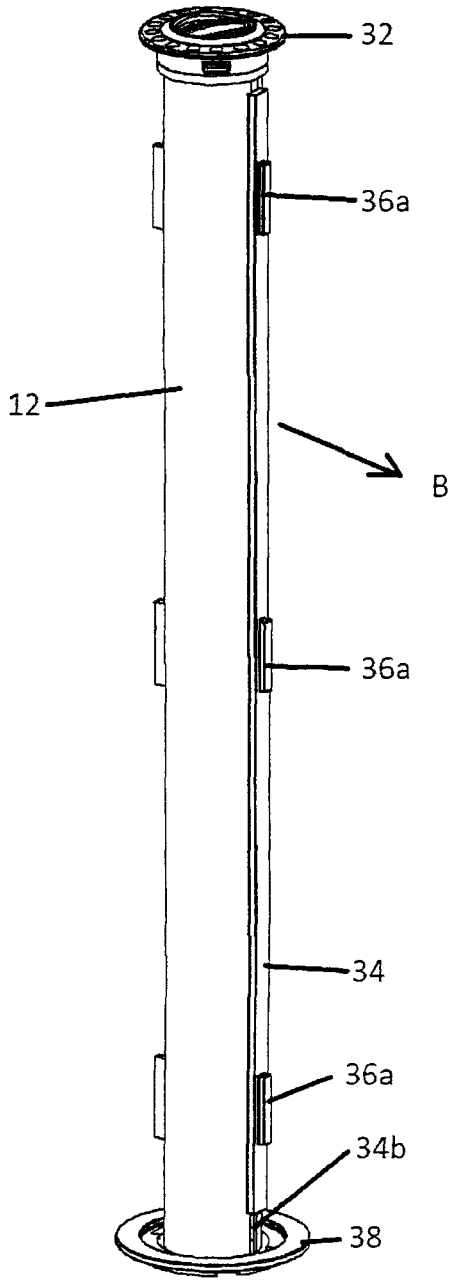
FIG. 6*b* is, in top perspective view the retractable fence system of FIG. 6*a* showing the post in its fully extended position.
Figure 6C:
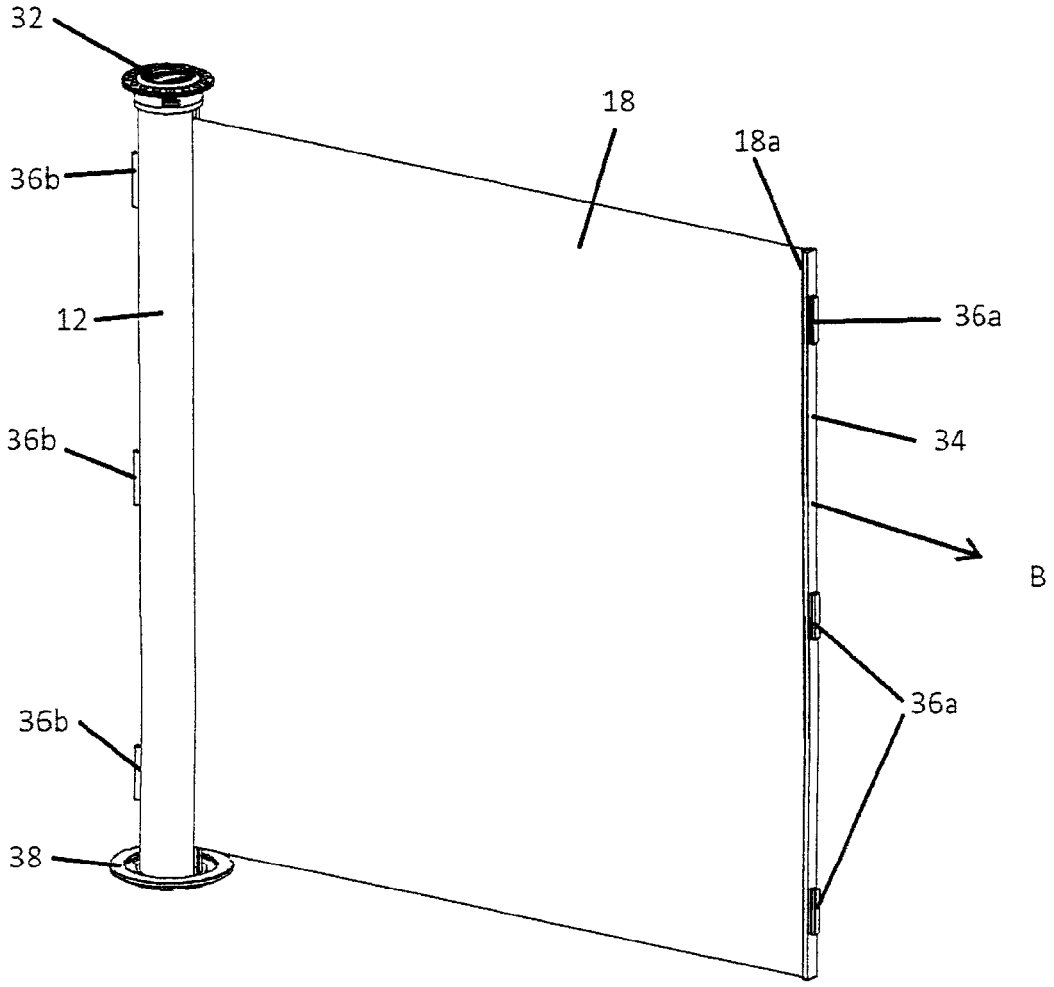
FIG. 6*c* is, the retractable fence system of FIG. 6*b* with the flexible fence panel partially extended from within the post.
Figure 6D:
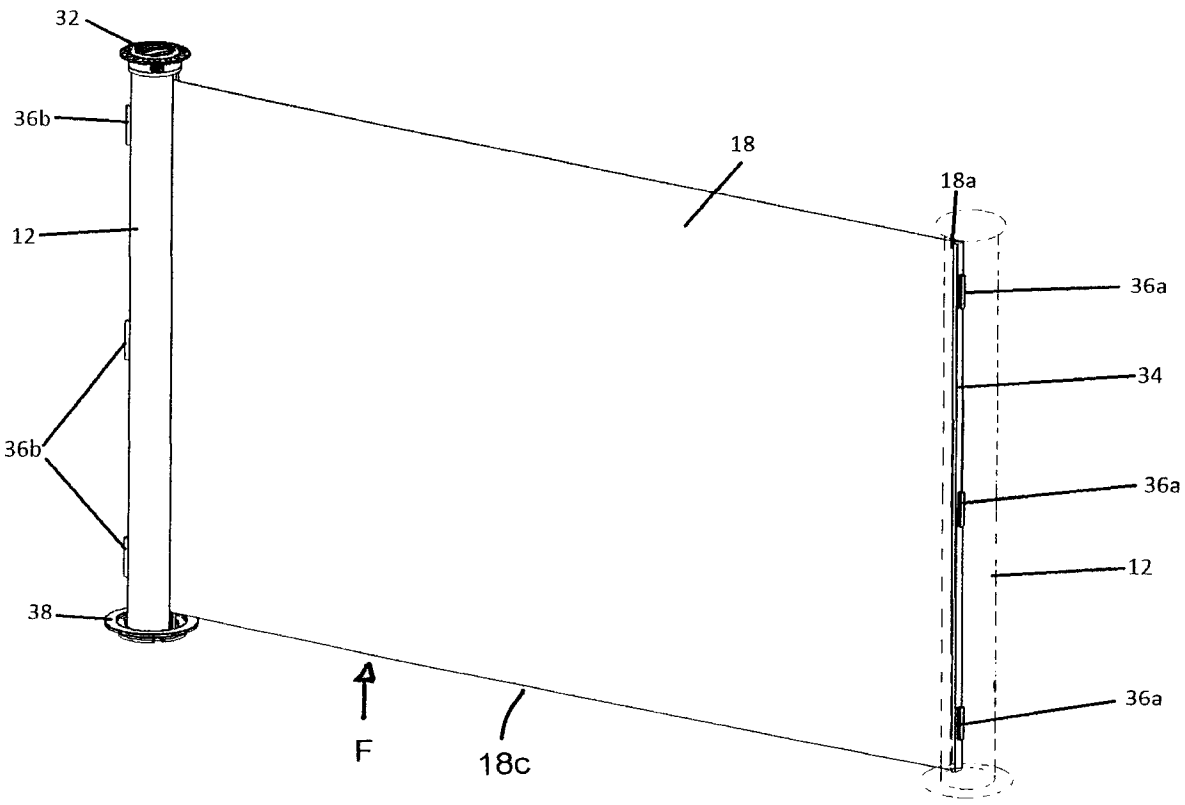
FIG. 6*d* is the retractable fence system of FIG. 6*c* with the flexible fence panel fully extended laterally of the post so as to engage the leading edge of the fence panel with the next adjacent post.
Figure 7A:
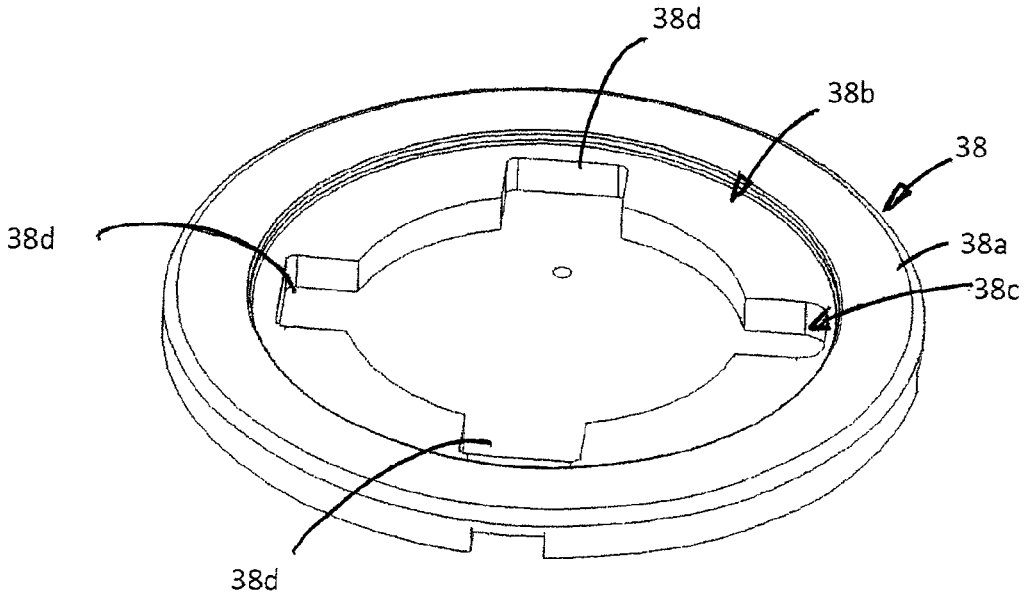
FIG. 7*a* is, in top perspective view, the collar of FIG. 4*c*.
Figure 7B:
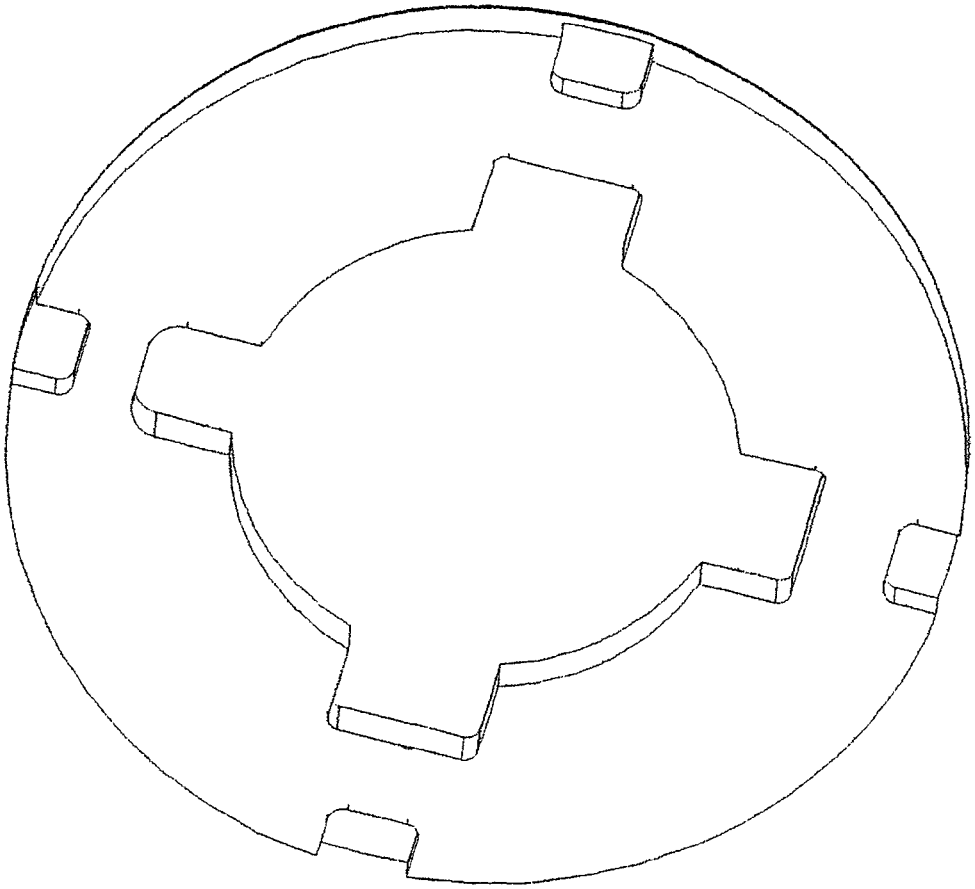
FIG. 7*b* is the collar of FIG. 7*a* in bottom perspective view.
Figure 8:
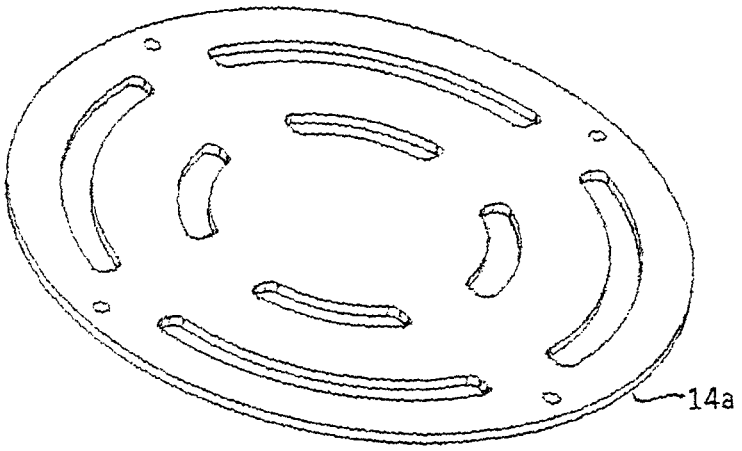
FIG. 8 is, in perspective view, the apertured base of the ground tube.

As may be seen in the illustrations and in particular in FIG. 5*b*, in one embodiment, not intended to be limiting, the roller spring mechanism within housing 40*a* may cooperate via spindle roller 40 with a ratchet and pawl mechanism (pawl not shown) mounted in cap base 32*b*. Advantageously, the ratchet mechanism for example actuated and locked by rotation of cap 32, or cam locking mechanisms or the like lock the flexible fence panel in place once it has been fully extended, until the latch is released by the user, again for example by rotation of cap 32 in its opposite direction. The locking in place of the flexible fence panel inhibits children from being able to pull up on the bottom edge 18*c* of the panel so as to lift it in direction F, or pull down on the upper edge of the panel, while pulling more of the panel material from post 12. If the flexible fence panel may be easily lifted, children may lift the fence panel in direction F and go under the upwardly bowed edge 18*c*, thereby defeating one of the objects of the pool surround and potentially endangering the children. If the panel maybe easily pulled down, children may pull the top edge of a fence panel down and climb over the panel. Consequently the locking of the fence panel on its roller once the panel is extended assists in preventing children going under or over the panel. Wires 19 along the top and/or bottom edge of the panel may assist in tightening the edges to prevent bowing of the edges.

A further latch mechanism is also provided to hold post 12 in its fully raised or fully extended position vertically out of tube 14. One such latch mechanism is illustrated, which is intended to be by way of example and not to be limiting, and includes a spring loaded pivoting latch arm 44 which is spring biased to swing outwardly in direction E from where it is recessed flush within the wall at the bottom end of post 12. As post 12 is pulled almost completely clear of tube 14 so that block 24 bumps up against the underside of collar 38, the bottom end 44*a* of latch arm 44 clears to top of collar 38 and springs radially outwardly of post 12. End 44*a* thus provides a latching barb which prevents the retraction of post 12 down into tube 14 until the user manually pushes the latching bar 44 back into its recess in post 12 to thereby allow post 12 to be lowered through collar 38 and into tube 14. Although only one latching bar 44 is shown, more than one, for example an oppositely disposed pair of latching bars 44 may be employed.

In one embodiment the ground post 14 has a diameter of approximately 8 inches and a length of approximately 4 feet, and the post 12 has a diameter of approximately 4 inches and a length of approximately 5 feet, although these dimensions are not intended to be limiting as would be understood by one skilled in the art.

In one embodiment, whether or not post 12 is retractable into tube 14, fence panel 18 may be used as a display media, for example for banner-type advertising so that not only do panels 18 serve as barriers, but they may also provide display surfaces, once extended, for corporate logos, advertising otherwise found on conventional media.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A retractable fence system comprising:

a plurality of hollow ground tubes adapted for mounting substantially vertically into ground, each ground tube of said plurality of hollow ground tubes containing a resiliently upwardly biased substantially hollow post, said post being upwardly biased within said ground tube by means of a resilient actuator journalled in each said ground tube and in contact with a lower end of the post for applying an upwardly biased force thereon, said post adapted for sliding vertically telescopic translation relative to said ground tube between a fully upwardly extended position and a fully lowered retracted position, each said post containing a retractable non-resilient flexible fence panel selectively retractably mounted within said post on a retractable means rotatably positioned within said post and affixed to a base end of said fence panel, said fence panel, when said post is in said extended position, selectively extendable from and retractable into said post between a laterally retracted position substantially fully contained within said post, and a laterally extended position extended laterally of said post, wherein each said post includes a vertical slot in a sidewall thereof and wherein said fence panel extends and retracts through said slot, and wherein each said fence panel has opposite base and leading ends, said base end mounted within said post, said leading end located in said slot when said fence panel is in its said laterally retracted position, a substantially rigid latching member mounted to said leading end of said fence panel, said latching member adapted to releasably mount to a next adjacent post corresponding to a next adjacent ground tube spaced apart in said plurality of hollow ground tubes, a collar rigidly mounted at an upper end of each said ground tube in sliding relation with said post, said collar substantially covering said upper end of said ground tube when said post is positioned in said collar, a post latching system comprising one or more biased latching means formed between said post and said tube for selectively latching each said post in both of said fully extended and fully retracted positions in said tube, a fence panel latching system formed at an upper end of said post and in cooperation with said retractable means of the fence panel for latching each said fence panel in said fully laterally extended position so as to inhibit deforming by lifting or lowering of said fence panel when extended by inhibiting further lateral extension of said fence panel from said post beyond the amount of lateral extension of said fence panel required to attain said fully laterally extended position, wherein said amount of lateral extension is dictated by a spacing distance between said post and said next adjacent post.

2. The system of claim 1 wherein each said post includes a traveler block mounted at the lower end of said post, said traveler block elongate in a longitudinal direction of said ground tube and sized to substantially snugly slidingly fit within said ground tube, and wherein said block travels vertically between said collar and said actuator.

3. The system of claim 2 wherein said traveler block and the inner wall of said ground tube include at least one mating vertical rail and corresponding channel for interlocked vertical sliding translation of said block along said tube.

4. The system of claim 3 wherein said channel is formed in said traveler block and said rail is on said inner wall.

5. The system of claim 2 wherein each said post includes an internal roller mechanism and said flexible fence panel is stored, when in said fully laterally retracted position, rolled within said post on said internal roller mechanism.

6. The system of claim 5 wherein each said fence panel latching system includes said internal roller mechanism and said actuator includes a spring.

7. The system of claim 6 wherein each said fence panel has a height dimension and wherein said height dimension is substantially equal to a longitudinal length of said post above said traveler block.

8. The system of claim 1 wherein each said rigid latching member includes at least one latch coupling member mounted thereon adapted to releasably couple to said next adjacent post when said fence panel is in said fully laterally extended position and wherein said next adjacent post is adapted to releasably couple to said coupling member, and wherein said collar includes at least one notch to accommodate vertical translation of said coupling member when carried in said vertical translation of said post relative to said collar.

9. The system of claim 8 wherein second latch coupling members are mounted on each said post for said coupling with said latch coupling member, and wherein further notches of said at least one notch are formed in said collar to accommodate vertical translation of said second latch coupling members.

* * * * *